US006124541A

United States Patent [19]

Lu

[11] Patent Number: 6,124,541

[45] Date of Patent: Sep. 26, 2000

[54] ELECTRONIC SOUND GENERATOR WITH MECHANICAL MOVEMENT FEATURE

[76] Inventor: Clive S. Lu, 282 Newbridge Rd., Hicksville, N.Y. 11801

[21] Appl. No.: 09/267,397

[22] Filed: Mar. 15, 1999

[51] Int. Cl.[7] ..... G10H 7/00

[52] U.S. Cl. ..... 84/600; 84/644; 446/242; 446/236; 446/297

[58] Field of Search ..... 84/600, 644, 94.1; 446/236, 242, 243, 297

[56] References Cited

U.S. PATENT DOCUMENTS

| | | | |
|---|---|---|---|
| Re. 34,717 | 9/1994 | Sanders et al. | 315/186 |
| 3,786,596 | 1/1974 | Breslow er al. | 46/98 |
| 3,942,884 | 3/1976 | Richards et al. | 353/9 |
| 4,545,775 | 10/1985 | Kim | 446/299 |
| 4,573,939 | 3/1986 | Hoshino | 446/298 |
| 4,676,764 | 6/1987 | Yeu | 446/298 |
| 4,712,184 | 12/1987 | Haugerud | 364/513 |
| 4,850,930 | 7/1989 | Sato et al. | 446/175 |
| 4,889,027 | 12/1989 | Yokoi | 84/635 |
| 4,890,828 | 1/1990 | Hou | 272/31 R |
| 4,900,289 | 2/1990 | May et al. | 446/342 |
| 4,911,676 | 3/1990 | Fan | 446/300 |
| 4,945,805 | 8/1990 | Hour . | |
| 4,952,189 | 8/1990 | Barlow | 446/241 |
| 4,985,883 | 1/1991 | Hou | 369/69 |
| 5,020,409 | 6/1991 | Hou | 84/95.2 |
| 5,070,753 | 12/1991 | Hou | 84/95.2 |
| 5,154,615 | 10/1992 | Joubert | 434/301 |
| 5,226,845 | 7/1993 | Wu | 446/265 |
| 5,259,806 | 11/1993 | Chang | 446/270 |
| 5,270,480 | 12/1993 | Hikawa | 84/645 |
| 5,385,344 | 1/1995 | Miller et al. | 273/460 |
| 5,485,068 | 1/1996 | Vaught | 446/297 X |
| 5,495,151 | 2/1996 | Lu | 318/4 |

*Primary Examiner*—Jeffrey Donels
*Attorney, Agent, or Firm*—Aquilino, Welsh & Flaxman

[57] ABSTRACT

A modular apparatus is provided for imparting movement and selected sound to an ornament. The apparatus includes an electronic and melody module, a mechanic transmission and power module, a base module, a power supply module, a visual module, and a melody tune integrated circuit (IC) module. The apparatus also includes a motor safety device which protects the motor from overheating and burning out when the movement of the apparatus is prohibited. The electronic and melody module includes a sound generator, a printed circuit board (PCB) assembly for controlling the output of the apparatus, and a slot receptacle for the melody tune IC card module. The mechanic transmission and power module includes a motor, a motor drive shaft, a transmission gear set connected to the motor drive shaft, and at least one axial action rod connected to the transmission gear set. The detachably connected modules provide versatility to the configuration of the apparatus.

10 Claims, 7 Drawing Sheets

FIG. 1
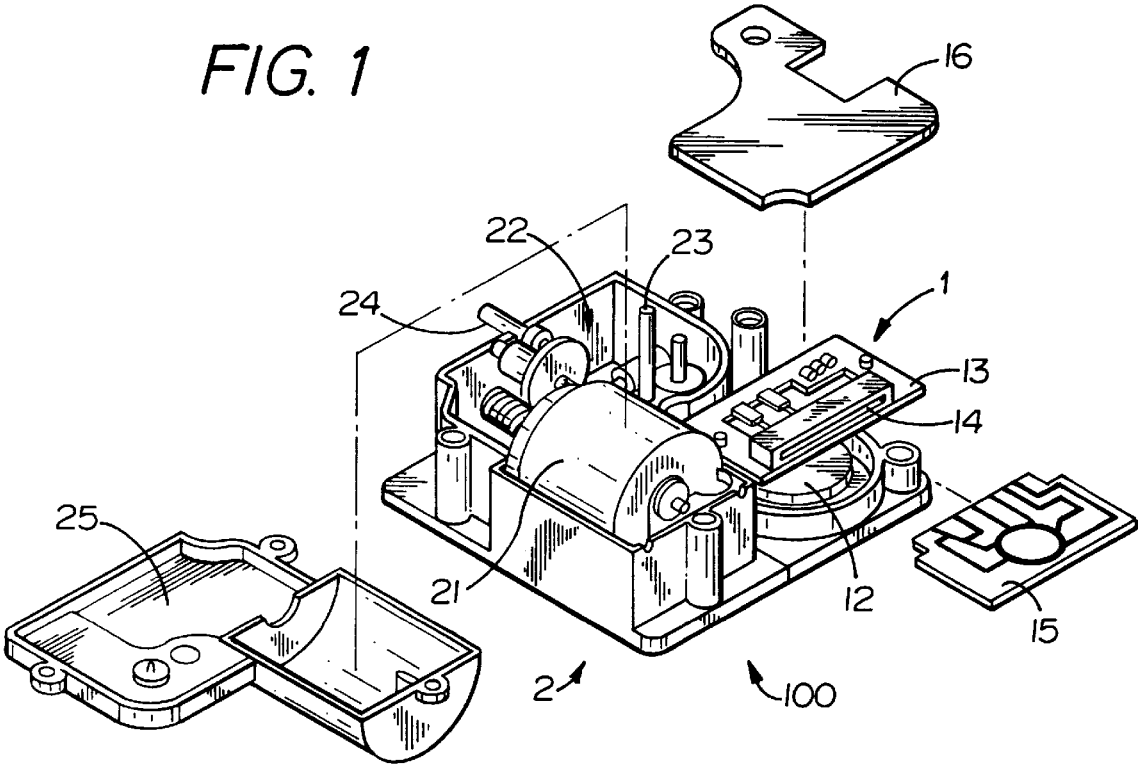
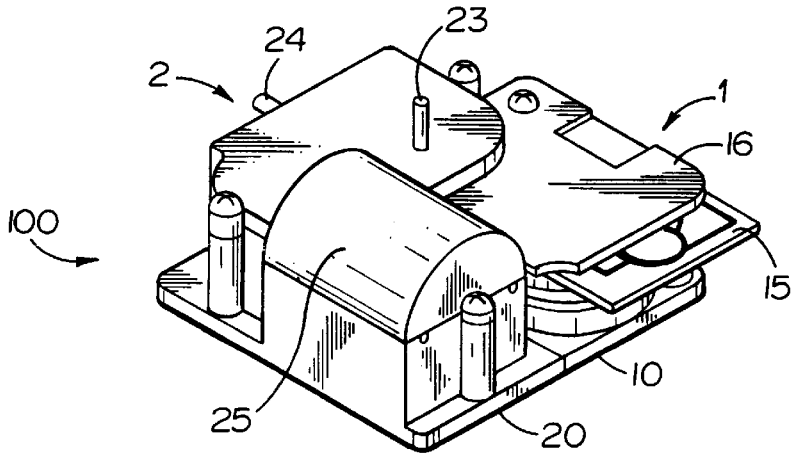
FIG. 2

ELECTRONIC SOUND GENERATOR WITH MECHANICAL MOVEMENT FEATURE

BACKGROUND OF THE INVENTION

1. Field of the Invention

The invention relates to the field of animation. More particularly, the invention relates to an apparatus for selectively and simultaneously imparting movement and selected sound, such as, speech or music melody to an ornament.

2. Description of the Prior Art

It has long been known to animate an ornament such as a doll by means of imparting movement through a mechanical mechanism. In the case of, for example, a hula dancing doll, appropriate music from an electronic melody circuit may also be provided.

While effective for imparting both movement and sound to the ornament or doll, the mechanical mechanisms and electronics disclosed in the prior art are not easily modified. The construction of the prior art device does not enable a user to easily customize the sound and movement output of the sound and movement generator.

Additionally, the prior art device does not include any built-in safety features designed to protect the sound and movement generator, specifically the motor, from being destroyed by misuse. In operation, the prior art devices may be intentionally or unintentionally damaged when a user prevents the mechanical movement device from moving freely, thereby preventing the motor from operating properly. Preventing the motor from operating properly may eventually cause the motor to burn out. This is not an uncommon problem with prior art devices.

As such, a need exists for an improved movement mechanism providing added versatility and safety features. The present invention provided such an apparatus.

SUMMARY OF THE INVENTION

It is, therefore, an object of the present invention to provide an apparatus for imparting movement and selected sound to an ornament overcoming the above described limitations and disadvantages of the prior art.

Another object of the present invention is to provide a versatile electronic sound generator with a mechanical movement feature, wherein the generator comprises several interchangeable modules. Specifically, the generator comprises interchangeable electronic and melody modules, mechanic transmission and power modules, and melody tune integrated circuit (IC) card modules. The interchangeable modules enable a user to easily customize the sound and movement by selecting, mixing and matching, and assembling the desired sound, movement, and IC card modules.

Still another object of the present invention is to provide an electronic sound generator with a mechanical movement feature, wherein the generator includes a motor for driving the mechanical movement and a safety device for protecting the motor from destruction caused by external forces acting on the mechanical movement mechanism. The safety device may be an electronic device that monitors the operation of the motor and controls the motor safely, based on measured parameters of the motor's operation. Alternatively, the safety device may be a mechanical device, such as a clutch, attached to the output of the motor. The mechanical device prevents external forces applied to the mechanical movement device from hindering the output of the motor, thereby preventing the motor from burning out due to the application of such an external force.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is an exploded view showing the various modules of the present invention.

FIG. 2 is a perspective view showing various modules assembled into one embodiment of the present invention.

DESCRIPTION OF THE PREFERRED EMBODIMENTS

Figure 3:
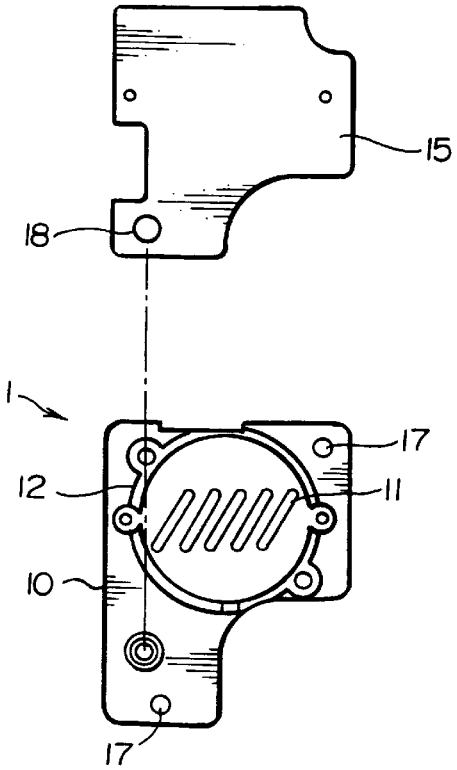
FIG. 3 is a partial exploded view showing an electronic and melody module with the module's top plate.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1, 2, 6 and 7, the elements of the present invention are disclosed. The present apparatus is an improvement over the inventor's own U.S. Pat. No. 5,495,151 entitled "Electronic Sound Generator with Mechanical Movement Feature", to Lu, which is incorporated herein by reference. The electronic sound generator with a mechanical movement feature, hereinafter referred to as the apparatus 100, includes several removably attached modules. The modules, which are easily replaceable, include an electronic and melody module 1, a mechanic transmission and power module 2, a base module 3, a power supply module 4, a visual module 5, and a melody tune IC card module 6. Each module is designed and constructed to precisely interact with the other modules when assembled into a desired apparatus 100. The modular design of the apparatus provides a number of significant benefits, including the ability to minimize production costs while increasing the versatility of the apparatus. The modular design increases the versatility by providing many combinations of movements and sounds which may be imparted by an apparatus 100 comprising the various modules.

Figure 6:
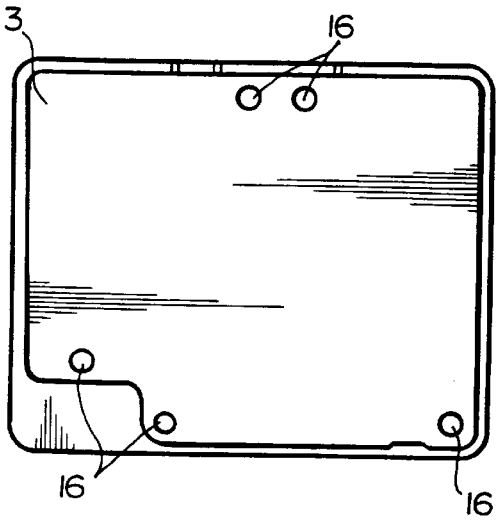
FIG. 6 is a top view of the base module.
Figure 5:
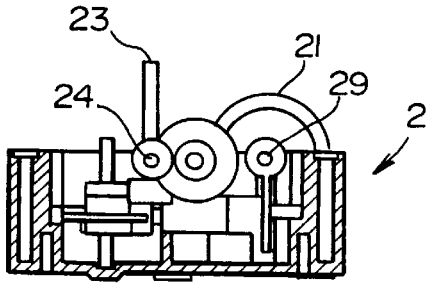
FIG. 5 is a side view of the mechanic transmission and power module shown in FIG. 4.
Figure 8:
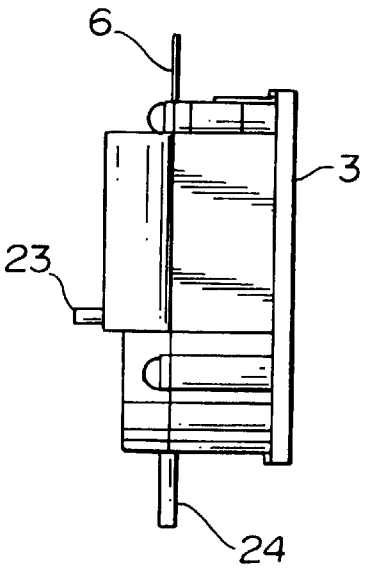
FIG. 8 is a side view of the embodiment shown in FIG. 7.

The apparatus 100 is assembled upon a generally flat base module 3. The base module 3, as shown in FIG. 6, is shaped and manufactured such that the electronic and melody module 1 and the mechanic transmission and power module 2 may be detachably secured to the base module 3. The base module 3 includes base fastening devices 16 used to attach other modules to the base module 3 in a desired configuration. Although screw holes are shown in FIG. 6 as the base fastening devices 16, other devices, such as snap fittings, may be used to detachably secure modules to the base module 3.

The electronic and melody module 1 includes a generally flat bottom base 10 and a top plate 15. The bottom base 10 is manufactured and configured for attachment directly to the base module 3. The bottom base 10 includes bottom base fastening devices 17 positioned to interact with the base fastening devices 16 when the electronic and melody module 1 is attached to the base module 3. Similarly, the top plate 15 includes top plate fastening devices 18 positioned to interact with the bottom base fastening devices 17 when the electronic and melody module 1 is assembled. Although screw holes are shown in FIG. 3 as the bottom base fastening devices 17 and the top plate fastening devices 18, other devices, such as snap fittings, may be used to attach the bottom base 10 to the base module 3 and to attach the top plate 15 to the bottom base 10.

Referring to FIG. 3, the electronic and melody module 1 also includes a sound generator 12 attached to the bottom base 10. The sound generator 12 is preferably a conventional piezoelectric design, however, other known sound generators may be used to provide similar results during operation. The sound generator 12 includes sound release slots 11 enabling the sound generator 12 to emit clear, high quality sound.

Figure 13:
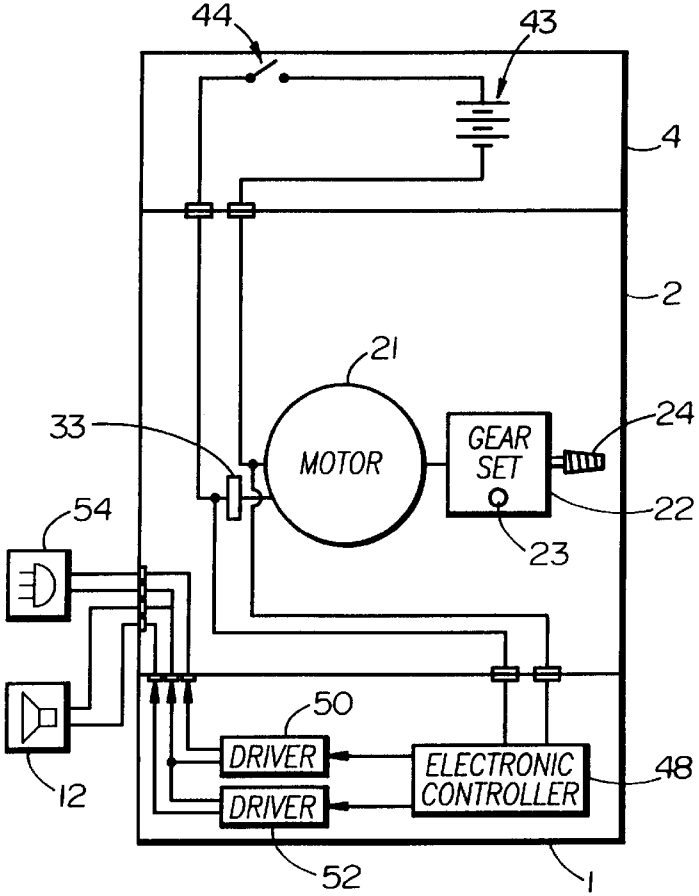
FIG. 13 is a schematic block diagram representation of the control circuit of the apparatus shown in FIG. 7.

Referring to FIG. 1, a printed circuit board (PCB) assembly 13, which electrically interfaces with the sound generator 12, is also included with the electronic and melody module 1. The PCB assembly 13 is positioned above the sound generator 12 on the electronic and melody module 1. As best shown in FIG. 13, the PCB assembly 13 includes an electronic controller 48 operatively connected to a pair of drivers 50, 52. Driver 50 provides a power signal for illuminating a visual module 5, shown in FIG. 13 as light emitting diodes (LED's) 54. Driver 52 controls the operation of the sound generator 12. Both drivers 52, 54 operate in accordance with control signals from the electronic controller 48. Thus, a light and sound display of a selected format, and in accordance with the specific control signals provided by the electronic controller 48, is provided.

The PCB assembly 13, as shown in FIG. 1, also includes a slot receptacle 14. The slot receptacle 14, electrically interfaced with the electronic controller 48 on the PCB assembly 13, provides an electrical and mechanical interface between a melody tune IC card module 6 and the PCB assembly 13. Thus, the slot receptacle 14 detachably interfaces the melody tune IC card module 6 with the electronic and melody module 1. Operating and melody information contained on the melody tune IC card module 6 is transmitted from the melody tune IC card module 6 to the electronic controller 48 on the PCB assembly 13.

Figure 4:
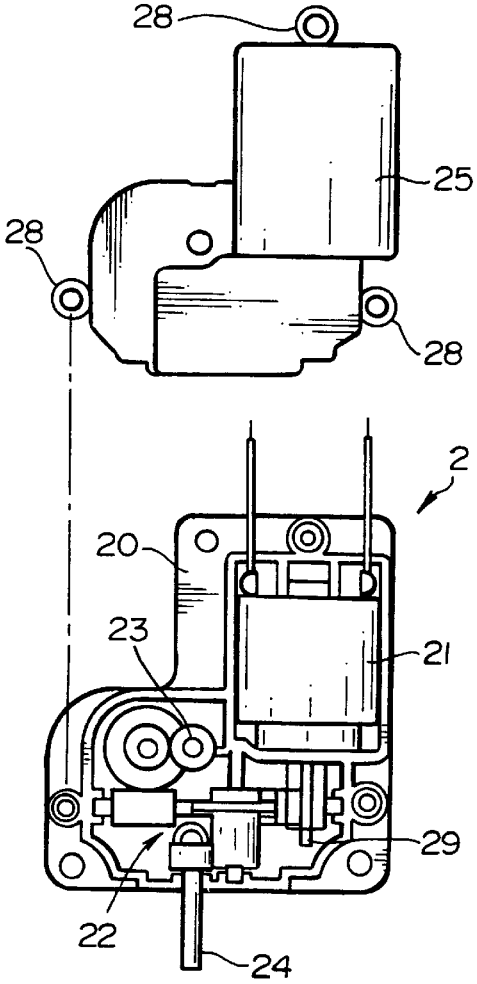
FIG. 4 is a partial exploded view showing the mechanic transmission and power module and the module's top plate.

Referring now to FIG. 4, the mechanic transmission and power module 2 includes a mounting base 20 and a cover plate 25. The mounting base 20 is manufactured and configured for detachable and direct attachment directly to the base module 3. The mounting base 20 includes mounting base fastening devices 27 positioned to interact with the base fastening devices 16 when the mechanic transmission and power module 2 is attached to the base module 3. Similarly, the cover plate 25 includes cover plate fastening devices 28 positioned to interact with the mounting base fastening devices 27 when the mechanic transmission and power module 2 is assembled. Although screw holes are shown in FIG. 4 as the mounting base fastening devices 27 and the cover plate fastening devices 28, other devices, such as snap fittings, may be used to attach the mounting base 20 to the base module 3 and to attach the cover plate 25 to the mounting base 20.

The mechanic transmission and power module 2 also includes a small low-noise, high-torque electric motor 21 attached to the mounting base 20. The motor 21 includes a motor drive shaft 29. The motor drive shaft 29 is operatively connected to a transmission gear set 22 of conventional arrangement. The transmission gear set 22 preferably drives a vertical output axial action rod 23 and a horizontal output axial action rod 24. The output axial action rods 23, 24 are uniquely arranged so as to extend in planes orthogonal to one another.

The vertical output axial action rod 23 is operatively connected to the transmission gear set 22 so as to turn counterclockwise at a speed of approximately 1.25 revolutions per minute. Preferably, the vertical output axial action rod 23 is threaded and has a diameter of 0.34 cm±0.1 cm and a thread per centimeter average of 16.25.

The horizontal output axial action rod 24 is operatively connected to the transmission gear set 22 so as to rotate clockwise at a speed of approximately 4–8 revolutions per minute. Preferably, the vertical output axial action rod 24 is reverse threaded and has a diameter of 0.29 cm±0.1 cm and an average of 22.5 threads per centimeter.

Thus, the mechanic transmission and power module 2 provides power transfer for mechanically driving the axial action rods 23, 24 in two orthogonal directions. The output axial action rods 23, 24 may be driven at differing speeds and in different directions as described or, of course, an alternative arrangement could be utilized: e.g. tappet rods in the same plane.

Figure 12:
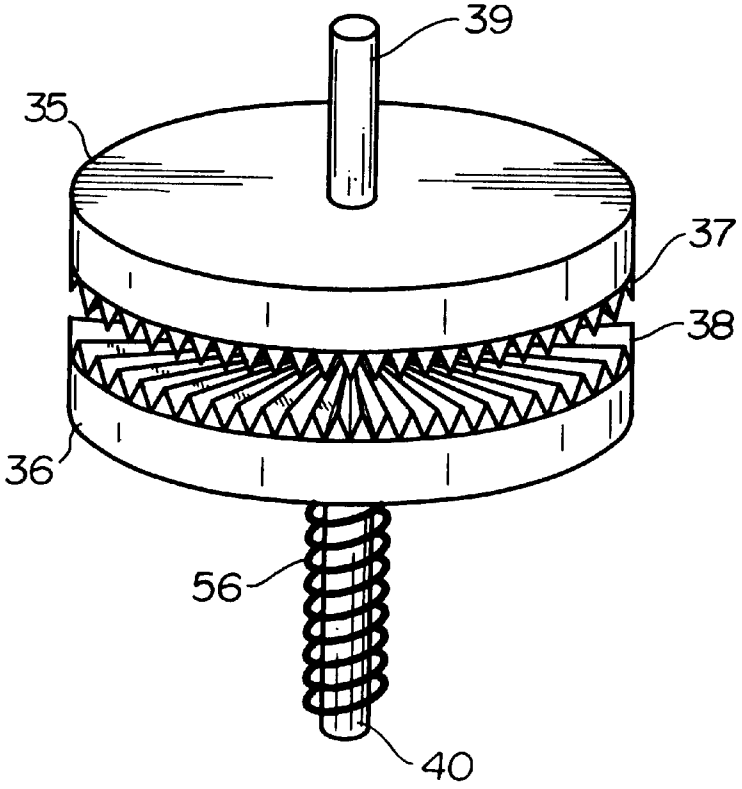
FIG. 12 is a perspective view of the mechanical motor safety device.
Figure 11:
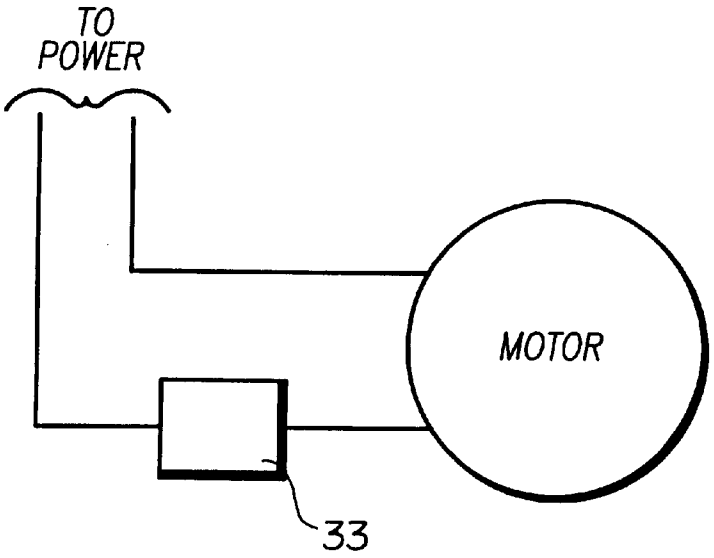
FIG. 11 is a schematic block diagram of the electronic motor safety device.
Figure 14:
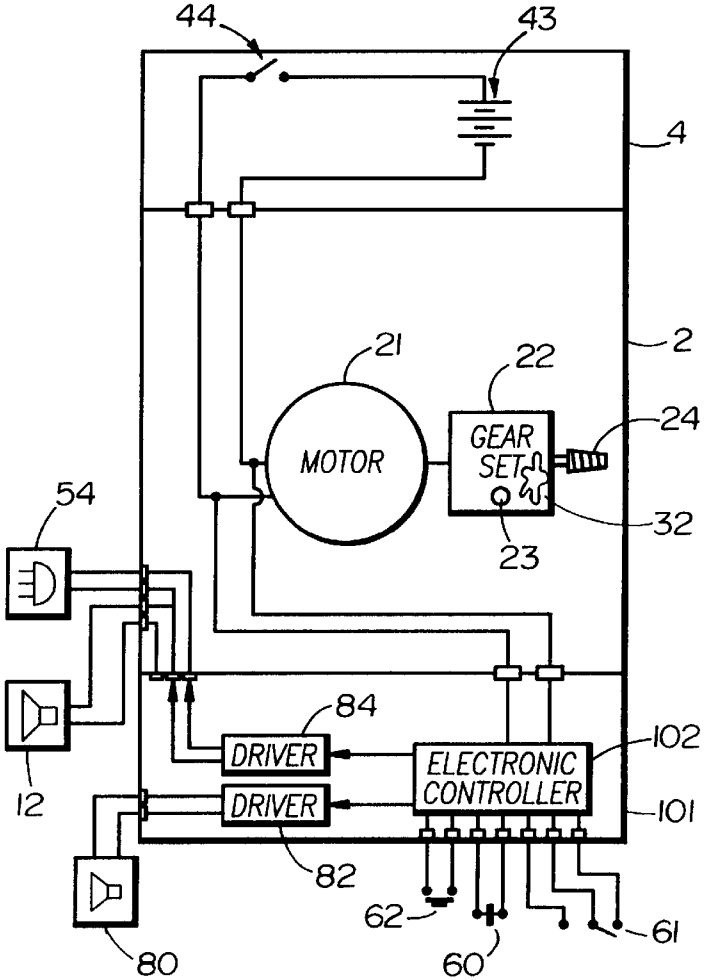
FIG. 14 is a schematic block diagram representation of the control circuit of the apparatus shown in FIG. 10.

Occasionally, an external force on the output axial action rods 23, 24 may restrict the rotation of the output axial action rods 23, 24, thus preventing the motor drive shaft 29 from rotating. This may cause the motor 21 to overheat and possibly burn out. To prevent this possible burn out, the apparatus 100 includes a motor safety device 30. The motor safety device 30 may be an electronic motor safety device 31, as shown in FIGS. 11 and 13, or a mechanical motor safety device 32, as shown in FIGS. 12 and 14. The motor safety device 30, which is part of the mechanic transmission and power module 2, is interfaced with the motor 21.

Referring to FIG. 11, the electronic motor safety device 30 includes a microprocessor 33 interfaced between the power supply module 4 and the motor 21. In operation, the microprocessor 33 monitors the voltage and current utilized by the motor 21 during operation. When the microprocessor 33 detects an irregular voltage or current, possibly caused when a restricted output axial action rod 23, 24 forces the motor 21 to overheat, the microprocessor 33 temporarily interrupts power supplied to the motor 21. By interrupting power to the motor 21, the microprocessor 33 turns off the motor 21. The microprocessor 33 interrupts the power for a short time period, preferably 1–2 seconds. Following the short time period, the microprocessor 33 restores power to the motor 21 and continues to monitor the voltage and current utilized by the motor 21. The process of temporarily interrupting the power is continued until the rotation of the output axial action rod 23, 24 is no longer restricted and the operating voltage and current remain within a normal operating range.

Referring to FIG. 12, a mechanical motor safety device 32 may be utilized as an alternative to the electronic motor safety device 31. The mechanical motor safety device 32 includes a clutch assembly 34 comprising a first clutch plate 35 and a second clutch plate 36. The clutch plates 35, 36 are generally disk shaped. Attached to the axial center of the first clutch plate 35 and projecting axially from the first face of the first clutch plate 35 is a first clutch plate axial rod 39. Attached to the axial center of the second clutch plate 36 and projecting axially from the first face of the second clutch plate 36 is a second clutch plate axial rod 40. A spring 56 is positioned around the second clutch plate axial rod 40. The second face of the first clutch plate 35 contains a rippled surface 37. Similarly, the second face of the second clutch plate 36 contains a rippled surface 38.

When assembled for operation, the rippled surface 37 of the first clutch plate 35 mates with the rippled surface 38 of the second clutch plate 36. The weight of an ornament attached to the first clutch plate axial rod 39 and the spring 56 surrounding the second clutch plate axial rod 40 provide pressure to keep the first rippled surface 37 in contact with the second rippled surface 38. The clutch assembly 34 is positioned in the mechanic transmission and power module 2 between the transmission gear set 22 and the output axial action rods 23, 24. A first clutch assembly 34 may be used to provide safety for the vertical output axial action rod 23, and a second clutch assembly 34 may be used to provide safety for the horizontal output axial action rod 24. The first clutch plate axial rod 39 is connected to the output axial action rod 23, 24. The second clutch plate axial rod 40 is connected to the transmission gear set 22.

In operation, the transmission gear set 22, driven by the motor 21 and the motor drive shaft 29, rotates the second clutch plate axial rod 40 and the second clutch plate 36. The rotating second clutch plate 36, which mates with the first clutch plate 35 via the rippled surfaces 37, 38, causes the first clutch plate 35 and the first clutch plate axial rod 39 to rotate. The first clutch plate axial rod 39 causes the output axial action rod 23, 24 attached to the first clutch plate axial rod 39 to rotate. When rotation of the output axial action rod 23, 24 is restricted, the rippled surface 37 of the first clutch plate 35 disengages from the rippled surface 38 of the second clutch plate 36. The disengagement allows the second clutch plate 36, the second clutch plate axial rod 40, the transmission gear set 22, the motor drive shaft 29 and the motor 21 to operate properly. Thus, the clutch assembly 34 prevents the motor 21 from overheating and burning out. When the output axial action rod 23, 24 rotation is no longer restricted, the rippled surfaces 37, 38 mate again, and normal operation continues.

Figure 7:
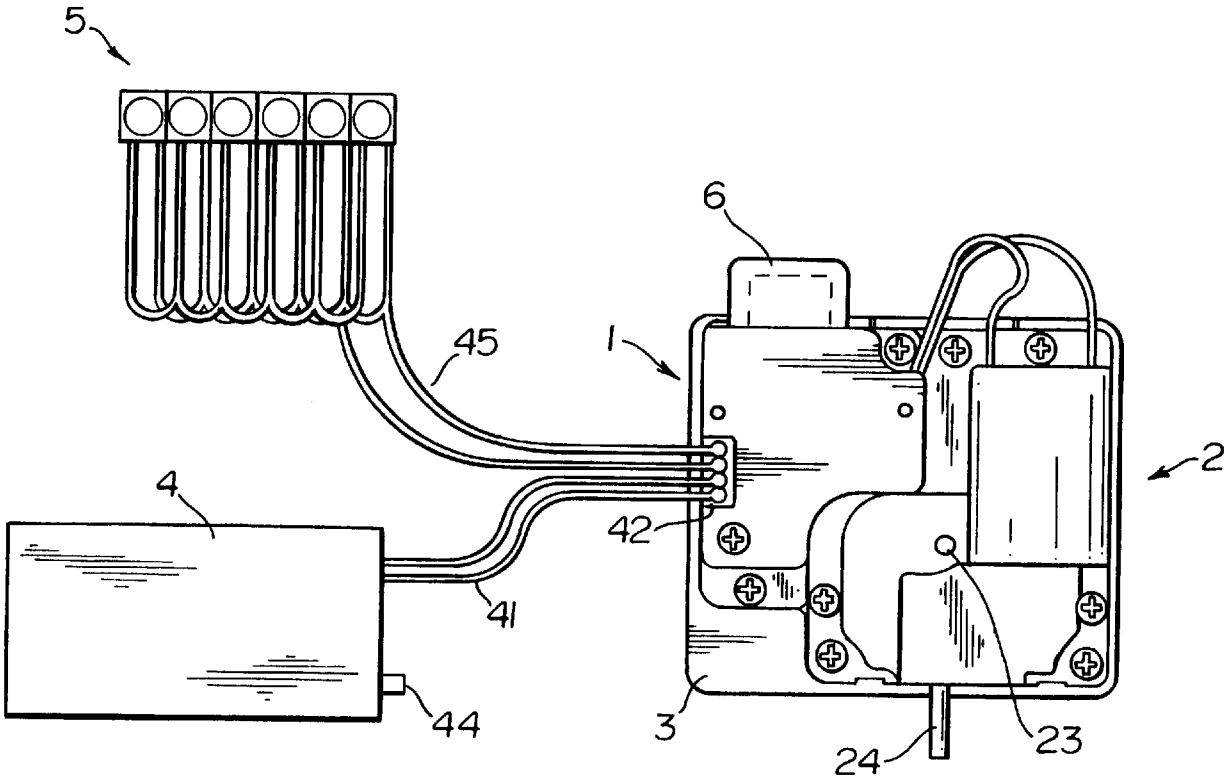
FIG. 7 is a top view of a second embodiment of the present invention.
Figure 9:
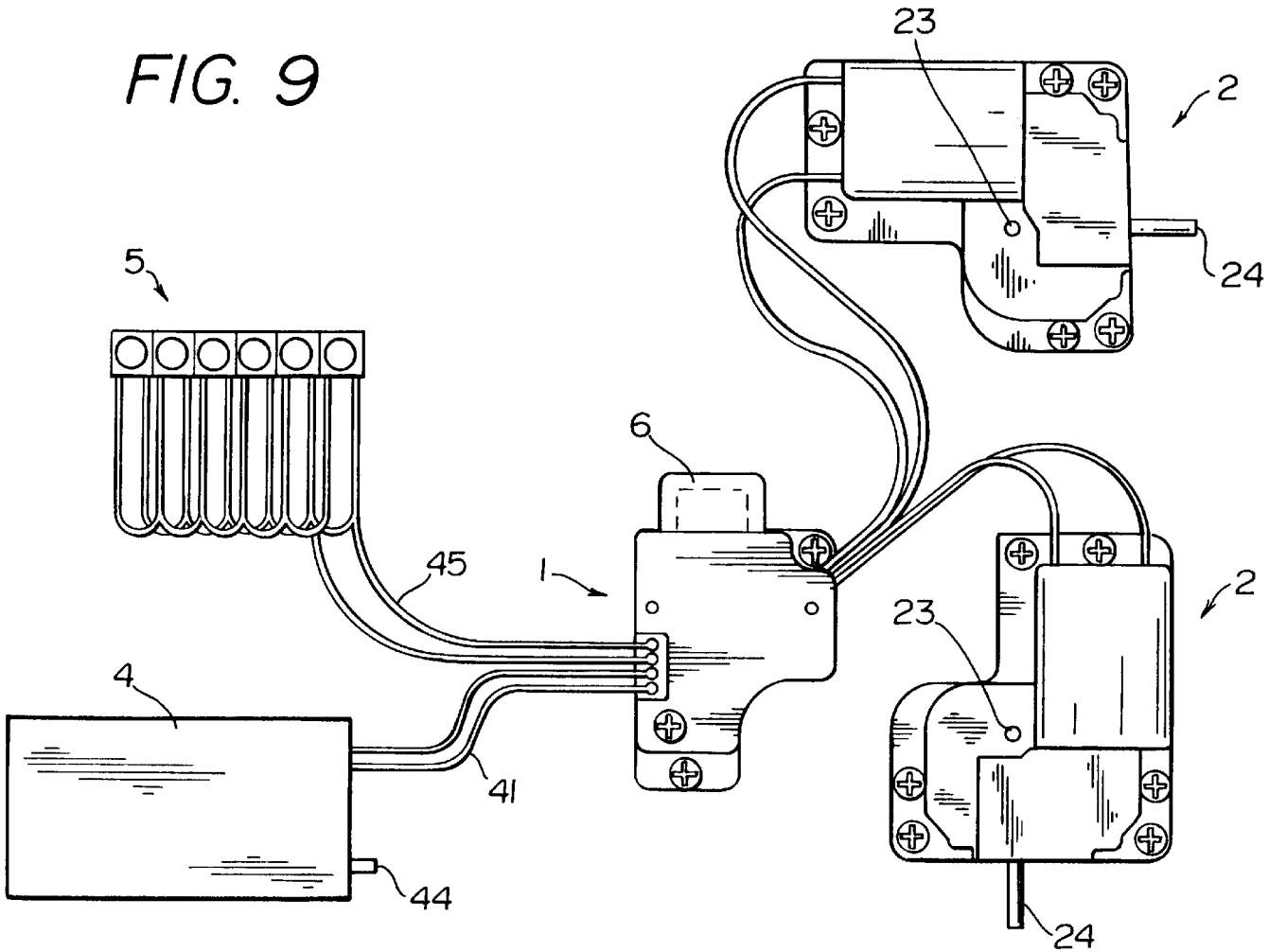
FIG. 9 is a top view of an assembled embodiment of the present invention showing the mechanic transmission and power module in various positions.

Referring to FIGS. 7 and 9, the apparatus 100 further comprises a power supply module 4 detachably connected to the electronic and melody module 1 via an electrical power cable 41. Matching electrical contacts 42 on the electrical power cable 41 and the electronic and melody module 1 complete the electrical connection. The power source is preferably a battery holder which receives and engages at least one battery 43 that provides the electrical power for the electronic and melody module 1 and the mechanic transmission and power module 2. An on/off actuator switch 44 may also be included as an integral component of the power supply module.

The apparatus 100 may also comprise a visual module 5 detachably connected to the electronic and melody module 1 via a power cable 45. Matching electrical contacts 42 on the power cable 41 and the electronic and melody module 1 complete the electrical connection. As shown in FIG. 13, the visual module 5, which may comprise LED's 54, is driven by a driver 50 and the electronic controller 48 located on the PCB assembly 12. The electronic controller 48 receives specific operating instructions from the melody tune IC card module 6 inserted in the slot receptacle 14. Various melody tune IC card modules 6 are available to provide a customized apparatus 100. Thus, a light and sound display of a selected format and in accordance with the signals provided by the electronic controller 48 is provided.

In operation, a user selects a specific electronic and melody module 1, a mechanical transmission and power module 2, a base module 3, a power supply module 4, a melody tune IC card module 6 and, optionally, a visual module 5. Physically, the apparatus 100 may be assembled by detachably securing the various modules to each other as described herein and in U.S. Pat. No. 5,495,151 to Lu. By selectively selecting assembling desired modules into an apparatus, the user may customize the sound, movement and light display imparted by the apparatus 100.

Figure 10:
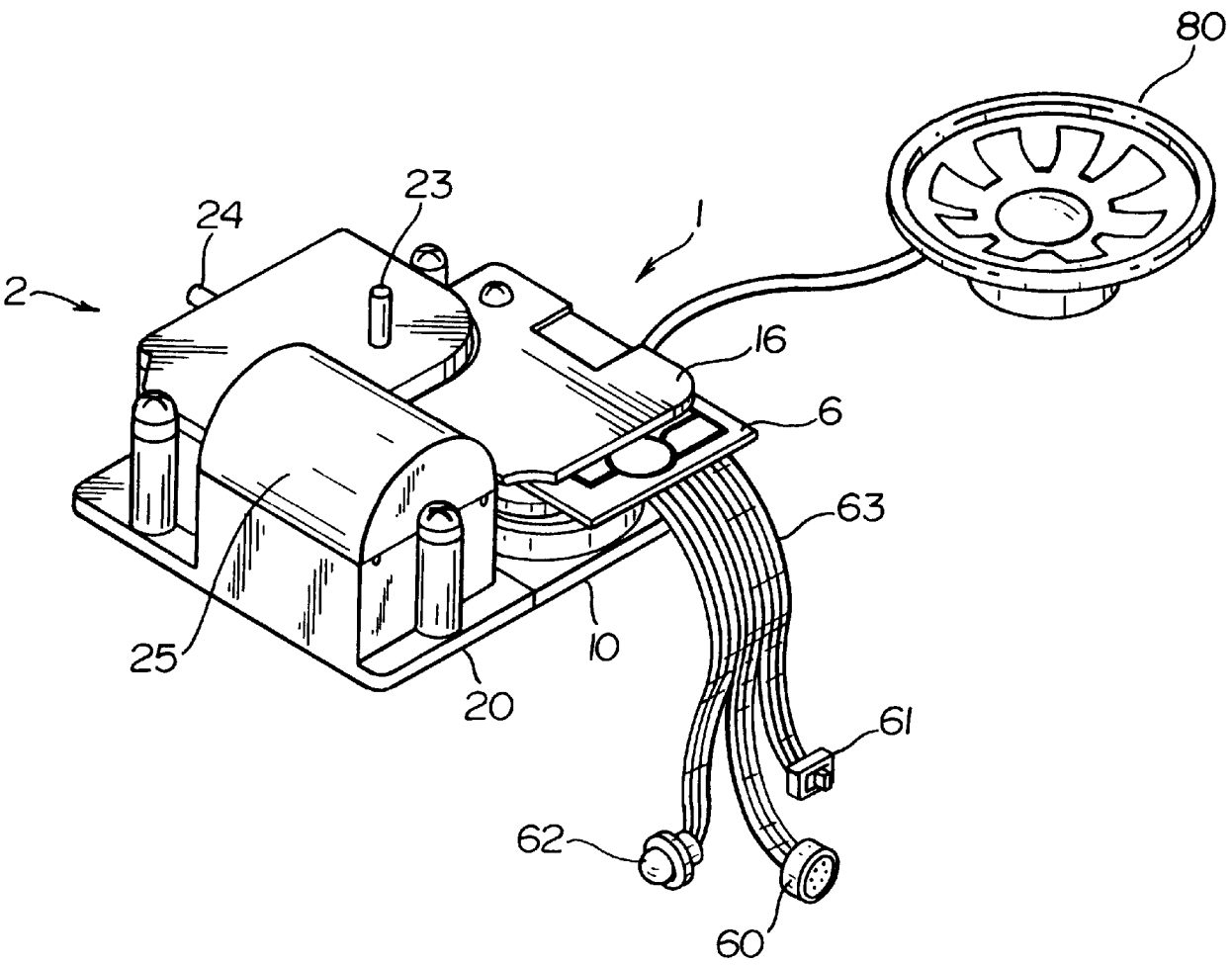
FIG. 10 is a perspective view of a third embodiment of the present invention.

In accordance with another aspect of the present invention an alternative embodiment of the apparatus 100 is disclosed in FIGS. 10 and 14. In the alternative embodiment, all the components and circuitry of the mechanic transmission and power module 2, the base module 3, and the melody tune IC card module 6 remain unchanged and are accorded the same reference numerals. Additionally, the optional LED's 54 are shown operatively connected in FIG. 14. However, a more advanced electronic and melody module 101, including an advanced electronic controller 102 is shown.

The electronic and melody module 101 includes an electronic controller 102 that allows selective recording and playback of end user selected sounds. As shown the electronic controller 102 is operatively connected to a microphone 60 to enable the recording of sounds, a control switch 61, and a replay push button 62. The electronic controller 102 is connected to a speaker 80 via a driver 82. As shown, the microphone 60, the control switch 61 and the replay push button 62 may all be connected to the electronic controller 102 by means of electrical wiring 63 so as to allow remote positioning at a convenient control location.

The electrical circuitry connection between the electronic controller 102 and the microphone 60, the control switch 61, the replay push button 62 and the speaker 80 is best shown in FIG. 14. As shown, the electronic controller 102 is directly connected to the microphone 60, the control switch 61, and the replay push button 62. The electronic and melody module 101 also includes a separate driver 84 for controlling the operation of the optional LED's 54.

In this embodiment, the user may select the record mode utilizing the control switch 61. By speaking or playing a musical tune into the microphone 60, a desired sound recording may be produced and retained in the electronic controller 102. The length of the recording depends upon the capacity of the integrated circuits of the electronic controller 102. It could, for example, be anywhere from 10 to 30 seconds in length. After recording, the control switch 61 is returned to the play mode. Then, upon activating the replay push button 62, the selected recorded message is generated through the sound generator 54 as controlled by the electronic controller 102 through the driver 84. Optionally, the recorded message may be played through the driver 82 and speaker 80. This alternative embodiment adds further sophistication to the apparatus 100 increasing its potential uses and markets.

In summary, numerous benefits result from employing the concepts of the present invention. Manufacturers, marketers and end users all benefit from the increased versatility of the apparatus of the present invention. The modular design allows the control of production costs and overhead. Also, the ability to readily select and change the combination of movements and sounds to be generated through the apparatus 100 increases the function and utility to the benefit of all parties. Additionally, the motor safety device 30 protects the motor 21 from burning out as a result of misuse of the apparatus 100. Finally, the alternative embodiment further increases the sophistication of the device allowing the end user to actually record his/her own selected sounds for generation whether they are voice messages or musical presentations.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A modular apparatus for imparting a desired movement and selected sound for customizing the sounds and movement of an ornament selectively secured thereto, comprising:

a mechanical transmission and power module imparting movement to an ornament selectively attached thereto;

an electronic and melody module;

a melody tune integrated circuit card module detachably secured to the electronic and melody module and the mechanical transmission and power module;

a power supply module detachably connected to the electronic and melody module;

circuitry for electrically interconnecting the mechanical transmission and power module, the electronic and melody module and the power supply module; and a base module for detachably securing the mechanical transmission and power module and the electronic and melody module in a selectively fixed position.

2. The apparatus as set forth in claim 1, further comprising a visual module detachably connected to the electronic and melody module.

3. The apparatus as set forth in claim 1, further comprising a microphone, a control switch, and a replay push button, wherein the microphone, the control switch and the replay push button are detachably secured to the electronic and melody module, enabling the module to selectively record and play back sounds input via the microphone.

4. The apparatus as set forth in claim 1, further comprising a motor safety device coupled to the mechanical transmission and power module for preventing the mechanical transmission and power module from being destroyed during use.

5. The apparatus as set forth in claim 4, wherein the motor safety device comprises an electronic safety microprocessor for protecting the mechanical transmission and power module.

6. The apparatus as set forth in claim 4, wherein the motor safety device comprises a mechanical clutch for protecting the mechanical transmission and power module.

7. The apparatus as set forth in claim 1, wherein the mechanical transmission and power module includes a mounting base, a motor mounted on the mounting base, a transmission gear set operatively connected to the motor, and at least one axial action rod operatively connected to the transmission gear set.

8. The apparatus as set forth in claim 7, further comprising a motor safety device coupled to the mechanical transmission and power module for preventing the motor from being destroyed when the at least one axial action rod is prevented from rotating.

9. The apparatus as set forth in claim 8, wherein the motor safety device comprises an electronic safety microprocessor for protecting the motor.

10. The apparatus as set forth in claim 8, wherein the motor safety device comprises a mechanical clutch for protecting the motor.

* * * * *